US011053930B2

(12) United States Patent
Rossetti et al.

(10) Patent No.: US 11,053,930 B2
(45) Date of Patent: Jul. 6, 2021

(54) POSITIVE-DISPLACEMENT PUMP AND PUMPING GROUP FOR FLUID PRODUCTS AND METHOD FOR THE USE THEREOF

(71) Applicant: ALFA S.R.L., Bologna (IT)

(72) Inventors: Edoardo Rossetti, Bologna (IT); Marco Rossetti, Bologna (IT)

(73) Assignee: ALFA S. R. L., Bologna (IT)

( * ) Notice: Subject to any disclaimer, the term of this patent is extended or adjusted under 35 U.S.C. 154(b) by 0 days.

(21) Appl. No.: 15/518,603

(22) PCT Filed: Oct. 13, 2015

(86) PCT No.: PCT/IB2015/057831

§ 371 (c)(1),
(2) Date: Apr. 12, 2017

(87) PCT Pub. No.: WO2016/059551

PCT Pub. Date: Apr. 21, 2016

(65) Prior Publication Data

US 2017/0248129 A1 Aug. 31, 2017

(30) Foreign Application Priority Data

Oct. 13, 2014 (IT) ..... BO2014A000555
Oct. 13, 2014 (IT) ..... BO2014A000556
Oct. 13, 2014 (IT) ..... BO2014A000557

(51) Int. Cl.
*F04B 13/00* (2006.01)
*F04B 7/00* (2006.01)
(Continued)

(52) U.S. Cl.
CPC ..... *F04B 13/00* (2013.01); *F04B 1/02* (2013.01); *F04B 7/003* (2013.01); *F04B 9/04* (2013.01);
(Continued)

(58) Field of Classification Search
CPC ..... F04B 13/00; F04B 7/0007; F04B 7/00; F04B 49/16; F04B 53/06; F04B 53/16; F04B 1/02; F04B 7/003
(Continued)

(56) References Cited

U.S. PATENT DOCUMENTS 1,528,097 A 3/1925 Cooper
2,497,300 A 2/1950 Elliott
(Continued)

FOREIGN PATENT DOCUMENTS

CN 2049697 U 12/1989
CN 103221688 A 7/2013
(Continued)

OTHER PUBLICATIONS

International Search Report issued in PCT/IB2015/057831 dated Apr. 11, 2016 (7 pages).
(Continued)

*Primary Examiner* — Charles G Freay
(74) *Attorney, Agent, or Firm* — Flynn Thiel, P.C.

(57) ABSTRACT

A positive-displacement pump for fluid products, in particular paints, colorants and the like, includes a pump body in which there is formed a pumping chamber, in which a piston is mounted for sliding and is controlled so as to advance and withdraw in order to vary the useful volume of the pumping chamber. The pumping chamber extends in accordance with a longitudinal axis which is inclined, in a non-vertical manner, with respect to a horizontal plane and having an upper region which is positioned at a greater height with respect to a horizontal plane and in the region of which the pumping chamber is placed in communication with at least one intake pipe of a fluid product.

34 Claims, 6 Drawing Sheets

(51) Int. Cl.

| | |
|---|---|
| ***F04B 53/06*** | (2006.01) |
| ***F04B 49/16*** | (2006.01) |
| ***F04B 53/16*** | (2006.01) |
| ***F04B 1/02*** | (2006.01) |
| ***F04B 9/04*** | (2006.01) |

(52) U.S. Cl.
CPC ..... *F04B 49/16* (2013.01); *F04B 53/06* (2013.01); *F04B 53/16* (2013.01)

(58) Field of Classification Search
USPC ..... 417/419, 518, 519, 298, 306, 517
See application file for complete search history.

(56) References Cited

U.S. PATENT DOCUMENTS

| | | | | | |
|---|---|---|---|---|---|
| 3,227,325 | A * | 1/1966 | Bates | B29C 31/063 | 222/309 |
| 3,909,160 | A * | 9/1975 | Sherrod | F04B 7/0023 | 417/517 |
| 4,089,624 | A * | 5/1978 | Nichols | B01L 3/0206 | 417/362 |
| 4,127,362 | A * | 11/1978 | Fladby | F04B 49/225 | 417/298 |
| 4,188,170 | A * | 2/1980 | Ito | F04B 43/067 | 417/387 |
| 4,288,206 | A * | 9/1981 | Tigwell | F04B 7/0015 | 417/517 |
| 4,358,257 | A * | 11/1982 | Seiler | F04B 53/164 | 417/517 |
| 4,467,703 | A | 8/1984 | Redwine et al. | | |
| 4,715,795 | A | 12/1987 | Habrich et al. | | |
| 5,330,331 | A | 7/1994 | Doede | | |
| 5,479,847 | A * | 1/1996 | Powers | F04B 7/0291 | 222/255 |
| 5,511,695 | A | 4/1996 | Chia et al. | | |
| 6,179,587 | B1 | 1/2001 | Kurth | | |
| 9,267,498 | B2 | 2/2016 | Kolln | | |
| 2006/0008365 | A1 * | 1/2006 | Angove | F04B 7/0003 | 417/415 |
| 2011/0274572 | A1 * | 11/2011 | Schwing | F04B 23/025 | 417/517 |
| 2012/0265128 | A1 | 10/2012 | Kolln | | |
| 2013/0259723 | A1 | 10/2013 | Salven et al. | | |

FOREIGN PATENT DOCUMENTS

| | | | |
|---|---|---|---|
| DE | 1403790 | A1 | 11/1968 |
| DE | 41 36 097 | C1 | 3/1993 |
| DE | 10 2009 057 792 | A1 | 6/2011 |
| EP | 0 193 752 | A1 | 9/1986 |
| EP | 0 959 005 | A2 | 11/1999 |
| EP | 2 174 009 | A1 | 4/2010 |
| EP | 2 525 094 | A1 | 11/2012 |
| FR | 2 832 467 | A1 | 5/2003 |
| JP | 58-126489 | A | 7/1983 |
| JP | 2006132502 | A | 5/2006 |
| WO | WO 86/02320 | A1 | 4/1986 |
| WO | WO 00/36302 | * | 6/2000 |
| WO | WO 00/46506 | A1 | 8/2000 |
| WO | WO 2008/105007 | A1 | 9/2008 |
| WO | WO 2009/003914 | A1 | 1/2009 |
| WO | WO 2012/072494 | A1 | 6/2012 |
| WO | WO 2020/169627 | A1 * | 8/2020 |

OTHER PUBLICATIONS

Written Opinion of the International Searching Authority issued in PCT/IB2015/057831 dated Apr. 11, 2016 (8 pages).

Office Action of Chinese Patent Office issued in China Application No. 201580055615.7 with English translation dated Sep. 3, 2018 (19 pages).

Search Report of European Patent Office issued in European Application No. 18215270, in English, dated Apr. 1, 2019 (10 pages).

* cited by examiner

POSITIVE-DISPLACEMENT PUMP AND PUMPING GROUP FOR FLUID PRODUCTS AND METHOD FOR THE USE THEREOF

FIELD OF THE INVENTION

The present invention relates to the field of dispensing fluid products such as paints, colorants and the like. The invention has been developed with particular regard to the dispensing machines used in order to discharge fluid products such as paints, colorants and the like. In greater detail, the invention relates to a positive-displacement pump for discharging such fluid products. The invention further relates to a pumping group which comprises a positive-displacement pump of that type. Furthermore, the invention relates to the method for using the positive-displacement pump and the pumping group for dispensing such fluid products.

TECHNOLOGICAL BACKGROUND

Machines for dispensing colorants comprise a plurality of tanks which contain fluid colorants. In order to obtain a paint of a specific colour, a dispensing machine provides for discharging predetermined quantities of the various colorants which are added to and mixed with a base paint which is contained in a can. The discharge of the colorants is brought about by means of the actuation of one or more positive-displacement pumps which take desired quantities of colorant from the respective tanks and transfer them to a dispensing nozzle, below which the can is positioned with the base paint.

The discharge of fluid colorant products poses some problems which are unknown in other fields of use of positive-displacement pumps, such as the field of discharging drinks or the field of injecting plastics materials. The fluid colorant products in fact have specific chemico-physical properties which require special arrangements. Many colorants are aggressive and corrosive, for which the pumps have to be resistant to wear. The fluid colorant products are further rather viscous and tend to enclose air at the inner side thereof, which has to be discharged before the start of the discharge operation proper, in order not to compromise the accuracy and the repeatability of the discharge operation.

In the field of dispensing machines for colorants, there are used various types of positive-displacement pumps. WO 1986/02320 sets out a dispensing machine of known type. This type of dispensing machine is generally provided with positive-displacement pumps of the gear type. Gear pumps allow high discharge volumes to be reached and are typically used for industrial type plants. This type of pump is particularly subject to wear, especially in the case where the fluid colorant products contain granular particles, such as, for example, in the case of metallic paints for bodies of motor vehicles.

U.S. Pat. No. 5,511,695 sets out a dispensing machine with positive-displacement pumps of the piston type. This type of pump has a rather large spatial requirement in addition to problems of wear and tightness in the region of the sliding seals.

WO 2000/46506 sets out an injection type pump for a dispensing machine comprising a pumping chamber with a variable volume defined by a bellows. The bellows extends and contracts under the thrust of a stepping motor. The extension of the bellows determines the intake of fluid product inside the pumping chamber through a non-return intake valve while the contraction of the bellows urges the fluid product towards the discharge pipe via a second non-return discharge valve. In this type of pump, the construction of the bellows is critical in order to ensure the reliability and repeatability and for this reason the pump is particularly expensive. Furthermore, the colorant tends to stop in the folds of the bellows, settling and reducing the performance levels and precision of the pump over time.

WO 2008/105007 sets out a pumping group for a dispensing machine for colorants. In this case, the discharge of colorant is brought about by means of a single screw pump having a helical rotor and a rubber stator. This pump has a limited capacity and cannot be operated at excessive speeds because it becomes heated and tends to seize.

EP2174009 sets out another type of positive-displacement pump for dispensing machines for colorants. In this case, a piston moves alternately inside a jacket in order to define a variable cylindrical volume. Behind the piston there is arranged an elongate element which is configured in the manner of a bellows and which acts as a seal and guide on the jacket. In this pump, the colorant tends to retain air therein; because the air is compressible, the precision and repeatability of the discharge of colorant by means of this pump are very unsatisfactory. Furthermore, in this pump the colorant tends to settle on the head.

STATEMENT OF INVENTION

An object of the present invention is to provide a positive-displacement pump and a pumping group which solve the problems of the prior art, and which in particular provide a high level of precision and repeatability for dispensing fluid products such as paints, colorants and the like. Another object of the invention is to provide a positive-displacement pump and a pumping group which are economical, reliable and which can ensure a long service-life with the nominal characteristics. Another object of the invention is to provide a positive-displacement pump and a pumping group which have compact dimensions and which are easy to assemble and maintain on a dispensing machine.

Another object of the invention is to provide a pump and a pumping group which can also discharge very small quantities of fluid product with precision and repeatability in order to allow a high level of precision in the reproduction of a great range of gradations of colour in the finished paints. Another object of the invention is to provide a pump and a pumping group which can readily be assembled in different configurations for volume and principle of use so as to be versatile in accordance with the specific characteristics of the fluid to be moved.

In order to achieve those objects, the invention relates to a pump, a pumping group and a method for the use thereof having the features defined in the appended claims.

According to one aspect, the positive-displacement pump for fluid products, in particular paints, colorants and the like, comprises a pump body in which a pumping chamber is formed. A piston is mounted for sliding in the pumping chamber. The piston is controlled so as to advance and withdraw in order to vary the useful volume of the pumping chamber. The pumping chamber is placed in communication with at least one intake pipe of a fluid product. The pumping chamber is placed in communication with at least one discharge pipe of a fluid product. The intake and discharge pipes are preferably formed so as to be integral in a head body which is mounted on the pump body. The construction of the positive-displacement pump as two main components allows use of the same pump body for different configurations of the intake and discharge pipes, with particular reference to the interception means of those pipes.

Preferably, the interception means of the intake pipe are mounted on the head body.

Advantageously, the interception means of the discharge pipe are mounted on the head body.

Preferably, a three-way valve is mounted on the head body incorporating the interception means of the intake pipe and the interception means of the discharge pipe.

Preferably, the three-way valve comprises an actuator member which is mounted on the head body.

Preferably, the piston is operationally connected to a motor which is mounted on a support which is fixed to the pump body.

Preferably, a single pumping pipe which branches off into the intake pipe and the discharge pipe leads from the pumping chamber.

Preferably, the single pumping pipe leads into the pumping chamber at an upper region thereof.

An adapter can be mounted inside the pumping chamber in order to reduce the volume thereof and therefore the cylindrical capacity. This allows the construction of a single pump body which can be used for different fluids and applications which require different cylindrical capacities.

Preferably, the pumping chamber comprises a substantially cylindrical portion with a constricted end. The adapter also comprises a cylindrical portion with a constricted end, whose geometry and external dimensions correspond substantially to the geometry and the internal dimensions of the pumping chamber so that the adapter is suitable for covering the internal walls of the pumping chamber in order to produce a smaller pumping chamber. In other words, the adapter fits completely with respect to the housing thereof which is constituted by the pumping chamber having greater dimensions.

Preferably, the external covering of the piston of the positive-displacement pump is of bellows-like form. The adapter has at the bottom an annular step which at the outer side moves into abutment with an abutment member at the end of the pumping chamber and at the inner side acts as an abutment for an annular portion having a greater diameter of a sleeve of a piston. The piston has a total diameter which is smaller than a piston which can be used in the pumping chamber without an adapter. The formation of the adapter and the reduced piston allow optimum performance levels in terms of sealing, precision and repeatability of the pump having a reduced cylindrical capacity.

Advantageously, the pumping chamber has a pumping opening which communicates with at least one intake pipe of a fluid product. The adapter comprises an opening which is placed in correspondence with the pumping opening of the pumping chamber. The fluid passage from and through the reduced pumping chamber is not therefore obstructed in spite of the presence of the adapter.

Preferably, the pumping opening and the opening of the adapter are positioned in an upper region of the pumping chamber and the reduced pumping chamber, respectively, which are positioned at a greater height with respect to a horizontal plane in order to promote the discharge of air from the reduced pumping chamber, in the same manner as that provided for the pumping chamber in terms of the greater dimensions thereof.

According to another aspect, the positive-displacement pump for fluid products comprises a pumping chamber, in which there is mounted in a sliding manner a piston which is controlled so as to advance and withdraw by a motor in order to vary the useful volume of the pumping chamber. The pumping chamber can communicate with a three-way valve. The three-way valve can be actuated in selective communication with an intake pipe and a discharge pipe. The independent actuation of the motor and the three-way valve allows the elimination of the air which may be contained in the fluid product to be brought about before starting the discharge operation proper, and further allows the recovery of the mechanical play of the pump and the start of the discharge operation without any resilient recovery thereof. In this manner, there is brought about a high level of precision and repeatability during operation of the positive-displacement pump.

Preferably, the pumping chamber extends in accordance with a longitudinal axis which is inclined with respect to a horizontal plane. Preferably, the longitudinal axis is not vertical. Even more preferably, the inclination is less than approximately 60° and even more preferably less than approximately 45°. This allows the air which may be enclosed in the fluid product to migrate naturally towards an upper region of the pumping chamber, which is positioned at a greater height with respect to a horizontal plane. Advantageously, the pumping chamber is placed in communication with the three-way valve at the upper region in order to promote the discharge of the air which may be contained in the fluid product and the introduction thereof into the tank before the discharge operation proper.

Advantageously, the pumping chamber of the positive-displacement pump comprises a substantially cylindrical portion with a constricted end. Preferably, the constricted end is substantially frustoconical. In this manner, the upper region may be positioned near or in the region of the constricted end, which is preferably substantially frustoconical, in order to produce a constructive simplicity of the pump, which is particularly compact.

According to another aspect of the positive-displacement pump, the outer skirt of the piston is in the form of a bellows. In this manner, there is produced a fluid-tightness without seals in the interface between the piston and the internal wall of the pumping chamber. The absence of seals makes it possible to use processing tolerances which are less extreme than those currently used in the pumps currently in use in the sector of dispensing colorants, paints and the like, which use materials such as glass, steel or ceramic material with lapped contact surfaces. In the positive-displacement pump which is described here, it is possible to use a more economical moulding operation of plastics material.

According to another aspect, the three-way valve of the positive-displacement pump comprises a valve chamber which is provided above the pumping chamber. Preferably, the intake pipe of the positive-displacement pump is inclined with respect to a horizontal plane from the valve chamber as far as the tank containing the fluid product. In this manner, there is obtained a spontaneous migration of the air from the pumping chamber as far as the tank, in a recirculation configuration of the pump.

According to another aspect, the positive-displacement pump comprises a pump body in which the pumping chamber is formed. The three-way valve comprises an actuation member which is mounted on a pump body for easier and more convenient assembly of the pump. Even more advantageously, the actuation member is inclined with respect to the vertical in order to reduce the spatial requirement.

Advantageously, the valve chamber, the intake pipe and the discharge pipe are formed so as to be integral in a head body which is mounted on the pump body, for ease of construction, assembly and maintenance.

According to another aspect, the valve chamber, the intake pipe and the discharge pipe are formed so as to be integral in a head body which is mounted on the pump body. In this manner, there is obtained great flexibility of use of the positive-displacement pump. For example, it is possible to produce a single pump body for various configurations of the positive-displacement pump, individually or in a pumping group with a single common three-way valve.

According to another aspect, the volume of the pumping chamber can be reduced by using a reduction adapter and a piston having dimensions which are correspondingly smaller. In this case, there is also produced a great flexibility and standardization of the pump which can be readily brought to various cylindrical capacities with limited costs.

According to another aspect, at least two positive-displacement pumps define a pumping group in which the positive-displacement pumps are operationally connected in such a manner that the withdrawal of the piston of another positive-displacement pump corresponds to the advance movement of the piston of one of the at least two positive-displacement pumps. Such a pumping group allows the production of a discharge which is almost continuous of a volume of fluid product greater than the cylindrical capacity of each positive-displacement pump of the pumping group.

Advantageously, in the pumping group the at least two positive-displacement pumps are connected by means of a gear mechanism controlled by a single motor. In this manner, there is ensured complete synchronization between the positive-displacement pumps.

According to another aspect, there is described a method for using a positive-displacement pump in which the intake pipe is connected to a tank of fluid product. The pump comprises a discharge pipe and interception members which can be selectively controlled in order to open and close the intake pipe and the discharge pipe. The method comprises the steps of:

controlling the interception members in order to open the intake pipe and to close the discharge pipe;

controlling the piston so as to withdraw in order to transfer a quantity of fluid product from the tank to the pumping chamber;

controlling the piston so as to advance by keeping the intake pipe open and the discharge pipe closed;

opening the discharge pipe and closing the intake pipe during the advance movement of the piston in order to discharge a quantity of fluid product.

Such a method allows any air which may be contained in respect of the pumping chamber and which has accumulated at the upper region thereof to be urged and to be returned to the tank before the discharge operation proper of fluid product begins, the precision and repeatability of which would be compromised by the significant presence of air in the fluid product.

BRIEF DESCRIPTION OF THE FIGURES

Additional features and advantages will be appreciated from the following detailed description of some preferred embodiments of the invention, given purely by way of non-limiting example and with reference to the appended drawings, in which.

DETAILED DESCRIPTION

Figure 1:
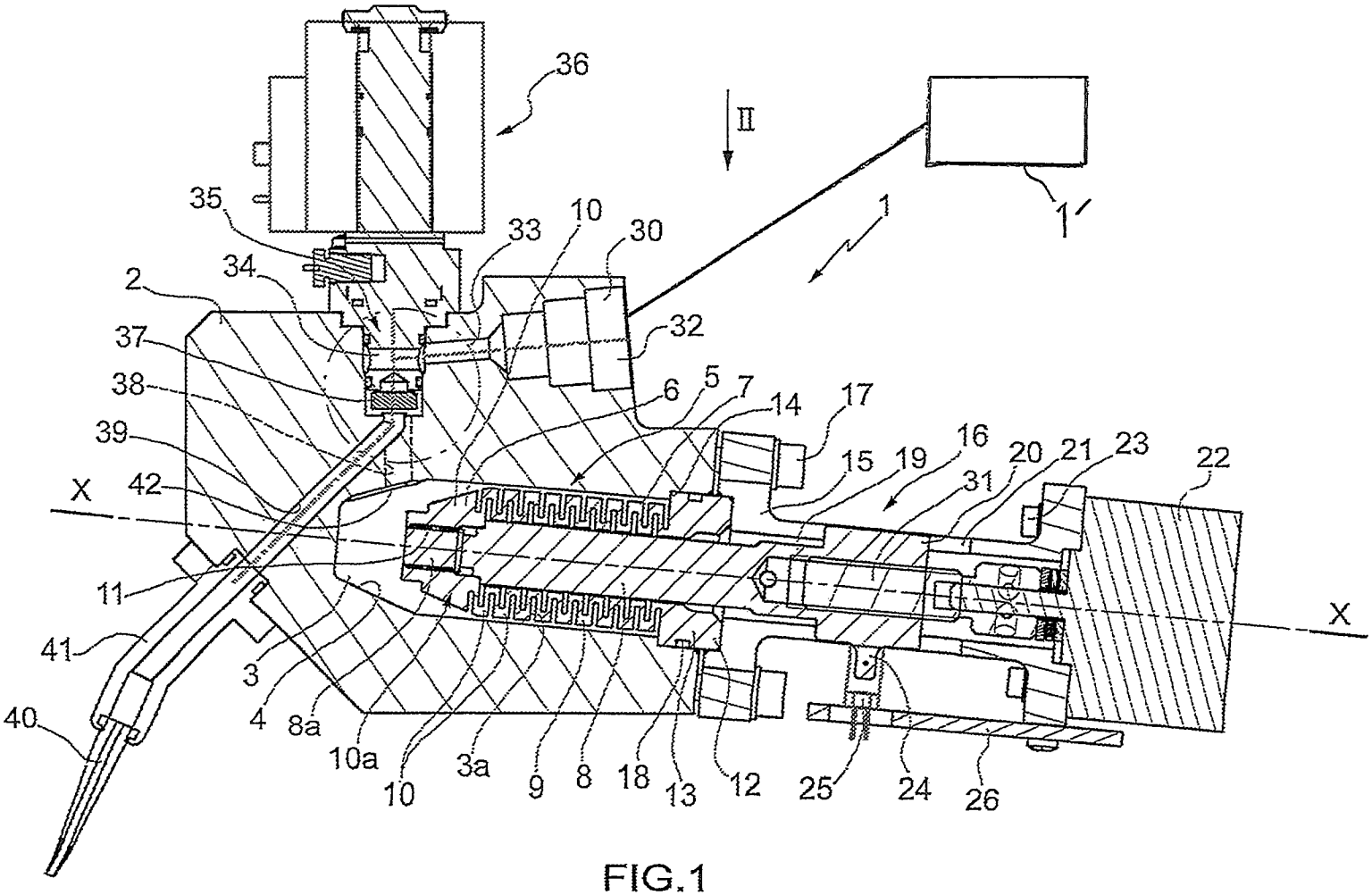
FIG. 1 is a longitudinal section of a positive-displacement pump according to the present invention.
Figure 2:
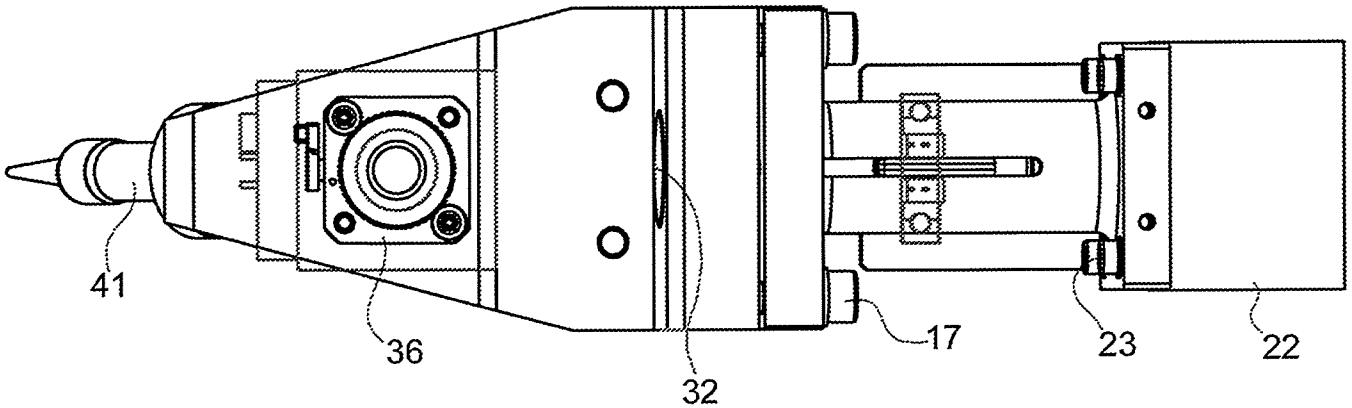
FIG. 2 is a plan view of the positive-displacement pump in accordance with the arrow II of FIG. 1.

With reference now to FIGS. 1 and 2, a positive-displacement pump 1 comprises a pump body 2 which defines a pumping chamber 3 which is elongate in accordance with a longitudinal axis X-X, which is slightly inclined with respect to a horizontal plane. The pumping chamber 3 comprises a cylindrical jacket 3*a* with a constricted end 4 which is preferably substantially frustoconical. Inside the pumping chamber 3, there is received in a sliding manner a piston 5 having a body 7 which is generally cylindrical and a constricted head 6, with a substantially frustoconical formation, which complements the end 4 of the pumping chamber 3. In greater detail, the piston 5 comprises a cylindrical central shaft 8, on which a sleeve 9 which is of bellows-like or zigzag form is fitted so as to provide a series of expansible circumferential corrugations or notches 10 at the external covering 10 thereof, acting as a seal and guide on the wall of the cylindrical jacket 3*a* of the pumping chamber 3. The sleeve 9 has a head end 10 which contributes to forming the head 6 of the piston 5. The head end 10 has an external covering 10*a* which is substantially frustoconical and a threaded axial hole 11 which is screwed onto the threaded end 8*a* of the central shaft 8. At the other bottom end 12 thereof, the sleeve 9 has an annular portion 13 which has a greater diameter and which is clamped between an abutment member 14 which is formed on the pump body 2 and a clamping flange 15 of a support group 16 of a motor 22, preferably a stepping motor. The motor 22 is fixed to the support group by means of screws 23 or other similar clamping means. The support group 16 is mounted in turn on the pump body 2 by means of screws 17 or other similar clamping means. There is formed on the external wall of the annular portion 13 an annular groove, in which an O-ring 18 or similar fluid-tight seal is received.

At the opposite side to the pumping chamber 3, the central shaft 8 of the piston 5 extends into a handling shank 19 with a longitudinal guiding fin 20 which is inserted in a slot 21 of the support group 16 of the motor 22. An extension piece 24 projects radially from the handling shank 19 in order to interact with a sensor 25 which is mounted on a support plate 26 which is fixedly joined to the support group 16. The handling shank 19 is connected to the stepping motor 22 by means of a handling screw 31 which allows a conversion of the rotational movement of the stepping motor 22 into a translation movement of the handling shank 19 and therefore of the piston 5 inside the pumping chamber 3.

Figure 3:
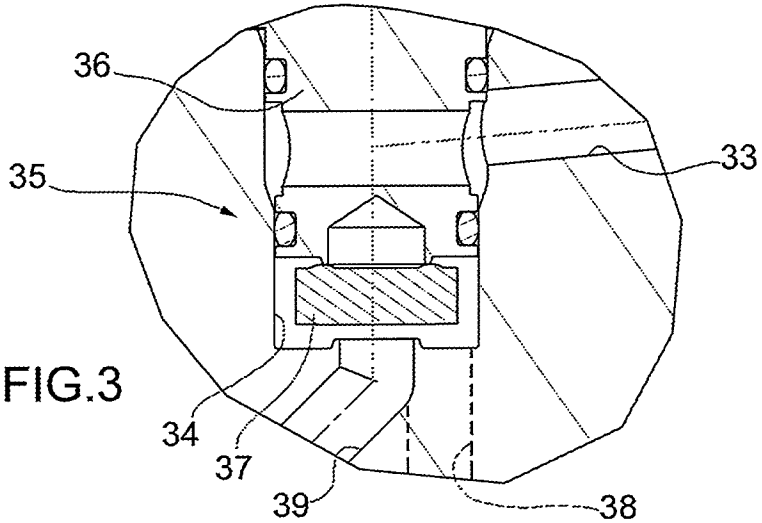
FIG. 3 is a cross-section, drawn to an enlarged scale, of a three-way valve of the positive-displacement pump of FIG. 1.

There is formed in the pump body 2 an intake pipe 30 which comprises an intake coupling 32 for a pipe which communicates with a tank 1' of fluid product which is illustrated diagrammatically in FIG. 1 and which is positioned at a greater height with respect to the positive-displacement pump 1 so as to produce a hydraulic head and a fluid travel with a constant descent from the tank, for reasons of elimination of the air, in accordance with the methods which will become clearer below. From the intake coupling 32, the intake pipe 30 comprises a slightly inclined portion 33 which descends with respect to a horizontal plane. The portion 33 leads into a chamber 34 of an interception member embodied by a three-way valve 35 which is illustrated more clearly in the enlarged illustration of FIG. 3.

The three-way valve 35 is controlled by an actuator 36 which is mounted on the pump body 2, preferably a solenoid valve actuator. The actuator 36 is connected in known manner to a valve closure member 37. There also leads into the chamber 34 a pumping pipe 38 which communicates with the pumping chamber 3 and a discharge pipe 39 which communicates with a discharge nozzle 40 which is carried by a discharge head 41 which is mounted on the pump body 2. The valve closure member 37 can be moved in the chamber 34 between two positions: a lowered intake position, in which the valve closure member 37 closes the discharge pipe 39 and allows the fluid communication between the intake pipe 30 and the pumping pipe 38, and a raised discharge position, in which the valve closure member 37 closes the intake pipe 30 and allows fluid communication between the pumping pipe 38 and the discharge pipe 39.

The pumping pipe 38 leads into the pumping chamber 3 in an upper region 42 which is placed in the region of the connection or transition between the cylindrical jacket 3*a* and the substantially frustoconical end 4. The relationship between the inclination of the longitudinal axis X-X with respect to a horizontal plane and the inclination of the lateral wall of the substantially frustoconical end 4 is selected in such a manner that the upper region 42 into which the pumping pipe 38 leads is located at the highest location of the pumping chamber 3. In this manner, any air contained in the fluid product which is intended to be pumped and which is contained in the pumping chamber 3 spontaneously ascends upwards in order to accumulate in the upper region 42 and to ascend from there into the pumping pipe 38 as far as the chamber 34 of the three-way valve 35 which is placed in an upper position with respect to the upper region 42. When the valve closure member 37 is in the intake position, the air is then capable of migrating towards the inclined portion 33 of the intake pipe 30 and of returning at that location to the tank connected thereto. This configuration allows the spontaneous elimination of any air which may be contained in the fluid product inside the pumping chamber 3, without any need for costly recirculation operations or additional forced extraction systems.

During use, the positive-displacement pump 1 is connected to a tank which is located above fluid product, such as a colorant or paint or the like, by means of a pipe which is connected to the intake coupling 32. For the reasons set out above with regard to the spontaneous elimination of the air, it is desirable for the connection pipe of the tank to the positive-displacement pump 1 to be inclined downwards from the tank to the positive-displacement pump 1. In a dispensing machine for fluid products, there are provided a plurality of positive-displacement pumps 1 for discharging fluid products in accordance with a discharge programme which is controlled by an electronic logic unit which controls the stepping motor 22 which moves the piston 5, and the actuator 36 which controls the opening and closing of the three-way valve 35. The electronic logical unit receives feedback information from the sensor 25 in order to control the positioning of the piston 5.

During operation of the positive-displacement pump 1, the piston 5 can be moved in translation for intake operation, by controlling the stepping motor 5 so as to rotate in a first direction and thereby actuating the control screw 31 which withdraws the piston 5, moving the head 6 thereof away from the end 4 of the pumping chamber 3, so as to increase the useful internal volume thereof. During the withdrawal of the piston 5, the corrugations 10 of the sleeve 9 move together.

Furthermore, the three-way valve 35 is controlled into the intake position so as to place in communication the intake pipe 30, and therefore the tank of fluid product, with the pumping pipe 38. The fluid contained in the tank can thereby fill the additional volume produced in the pumping chamber 3. The head pressure which is established by the depth of the tank, the intake speed of the piston 5 and the speed of the fluid product processed, as well as the diameters of the various pipes, are parameters which are considered in the projection of the dispensing system and the electronic logic unit in order to ensure correct priming of the positive-displacement pump 1 at the first actuation thereof, with an empty pumping chamber 3.

When the pumping chamber 3 is full of fluid product and the piston 5 is in the maximum withdrawal position thereof, the piston 5 can be actuated in the opposite direction, that is to say, in the advance direction, as a result of a reversal of the rotation direction of the stepping motor 22. In this case, the positive-displacement pump 1 can operate with recirculation or discharge of the fluid product, in accordance with the position taken up by the three-way valve 35. If the three-way valve 35 is maintained in the intake position, in which the pumping pipe 38 is in communication with the intake pipe 30 and the discharge pipe 39 is closed, then the fluid product contained in the pumping chamber 3 is urged again towards the tank which is connected to the intake pipe 30. That is a recirculation or movement condition of the fluid product which allows it to be kept moving in order to prevent sediments or dry matter in the pipes which extend from the tank to the pumping chamber 3. Furthermore, the movement of the piston 5 in an advance direction allows recovery of the mechanical play in order to bring the system into a zero predetermined condition, which is important for the precise and repeatable adjustment of the discharge of fluid product. Finally, the advance movement of the piston 5 with recirculation promotes the discharge of any air which may be contained in the fluid product and which has been accumulated naturally in the upper region 42 or in the pumping pipe 38 and which is urged back towards the tank through the intake pipe 30.

The switching of the three-way valve 35 during the operation of the piston 5 in an advance direction allows a change from the above-described recirculation condition to the discharge condition, in which the fluid product contained in the pumping chamber 3 is urged through the pumping pipe 38 and redirected into the discharge pipe 39 as far as the nozzle 40, while the intake pipe 30 is closed by the valve closure member 37. In the positive-displacement pump 1 of the present invention, it is particularly advantageous that the change to the discharge condition does not involve the interruption of the pressure applied by the piston 5 to the fluid product. This allows the fluid product to be maintained under pressure in such a manner that the influence of the air which may still be contained in the fluid product on the volume of the system is minimized, thereby reducing to a minimum the volumetric variations of the fluid product which would otherwise cause a low level of repeatability of the discharge in subsequent pumping operations. The first step of the advance travel of the piston 5, in the recirculation condition of the three-way valve 35, contributes to the elimination of any air contained in the fluid product. Subsequently, in the discharge condition, the pressure of the piston 5 on the fluid product during the advance travel may typically reach from 10 to 15 bar and at this pressure the influence of any residual air enclosed in the fluid product becomes almost insignificant from the point of view of volume. The result is that the performance levels in terms of volume and the precision of discharge of the positive-displacement pump 1 of the present invention are predictable, measurable and repeatable with a very high level of precision. In other words, the first step of the advance travel of the piston compresses the air enclosed in the fluid product and makes the system particularly immune to the influence thereof on the discharge performance levels of the positive-displacement pump. In the first advance step of the piston, therefore, the air present at the upper portion of the pump is discharged from the pumping chamber 3; the air remaining in the fluid product which is not discharged in this manner is compressed to a pressure which is in accordance with the head, the connections and the ambient pressure but which is still far greater than ambient pressure.

Furthermore, the fact that the piston 5 remains under compression during the switching to the discharge condition of the fluid product prevents any relaxation of the mechanical play which is taken up during the first step of the advance travel thereof, in the recirculation condition, substantially thereby also improving the precision and the repeatability of discharge of the fluid product.

The positive-displacement pump 1 described above can be produced with construction variants which make the production, maintenance and use thereof advantageous.

Figure 4:
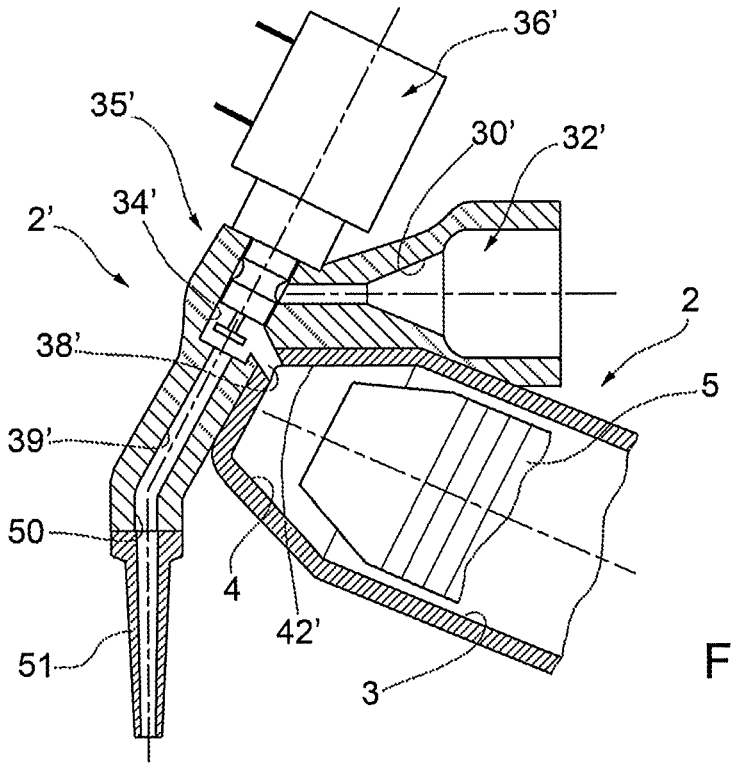
FIG. 4 is a cross-section, drawn to an enlarged scale, of a variant of the valve group and discharge group of the positive-displacement pump of the present invention.

FIG. 4 illustrates a variant of the positive-displacement pump of the present invention which comprises a head group 2' which is constructed to be separate from the pump body 2 and which is connected thereto using screws, bolts or the like (not illustrated). In greater detail, there is constructed in the head group 2' an intake pipe 30' with an integral intake opening 32' for connection to a tank of fluid product (not illustrated). The pumping chamber 3 having the sliding piston 5 therein is inclined in such a manner that the upper region 42' thereof, that is to say, the highest location thereof with respect to a horizontal plane, is substantially at the most advanced region of the substantially frustoconical end 4. The upper region 42' is pierced so as to form an extremely short pumping pipe 38' in communication with the valve chamber 34' of the three-way valve 35' which is actuated by the actuator 36' which, in the configuration illustrated in FIG. 4, is advantageously inclined with respect to the vertical, with a reduction of the dimensions in that direction. There extends from the valve chamber 34' the discharge pipe 39' which is advantageously arranged in a position near the pumping chamber 3 in order to further reduce the dimensions of the positive-displacement pump in the horizontal direction. At the end 50 of the discharge pipe 39', there is mounted a discharge nozzle 51 which is separate from the head group 2' in order to allow easier replacement thereof in the event, for example, of blockages as a result of sediments.

Figure 5:
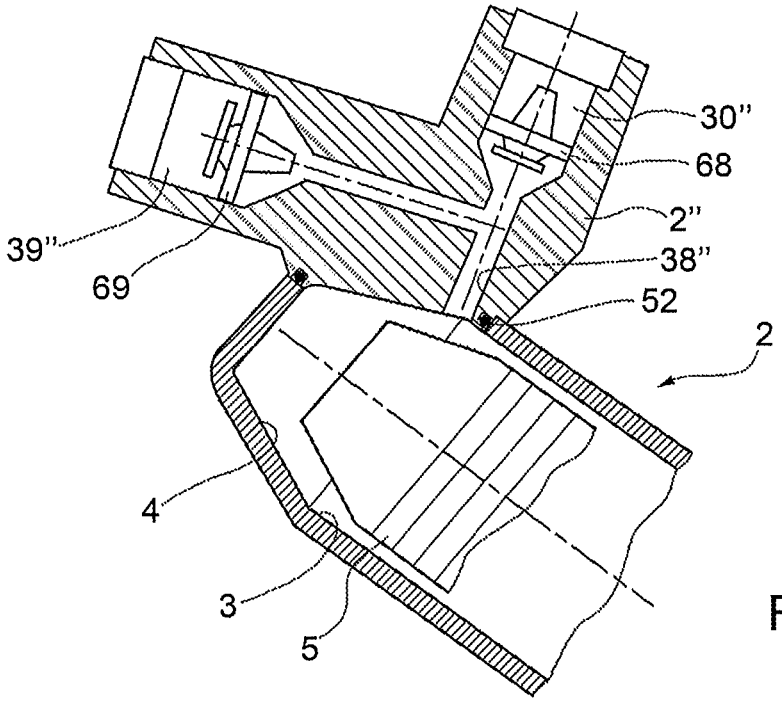
FIG. 5 is a cross-section, drawn to an enlarged scale, of another variant of the valve group and discharge group of the positive-displacement pump of the present invention.

FIG. 5 schematically illustrates another variant of the positive-displacement pump of the present invention which comprises a head group 2" which is constructed to be separate from the pump body 2 and which is connected thereto using screws, bolts or the like (not illustrated), with the interposition of a seal 52. Unlike the embodiments described above, the head group 2" does not comprise a three-way valve but instead includes interception members embodied by a non-return intake valve 68 which is mounted on the intake pipe 30", and a non-return discharge valve 69 which is mounted on the discharge pipe 39". The switching between the intake condition and the discharge condition is brought about automatically by means of the unidirectional behaviour of the non-return valves 68 and 69. When the piston 5 moves back, the non-return discharge valve 69 closes while the non-return intake valve 68 is free to open so as to cause the fluid product to flow from the tank connected to the intake pipe 30" to the pumping chamber 3 through the pumping pipe 38". When the piston 5 advances, however, the non-return intake valve 68 closes while the non-return discharge valve 69 is free to open so as to cause the fluid product to flow from the pumping chamber 3 to the discharge nozzle connected to the discharge pipe 39'. It is possible to provide for an external controlled valve, which is preferably a three-way valve, in order to actuate the recirculation of the fluid product towards the tank, as will become clearer below with reference to the example of FIG. 8.

Figure 6A:
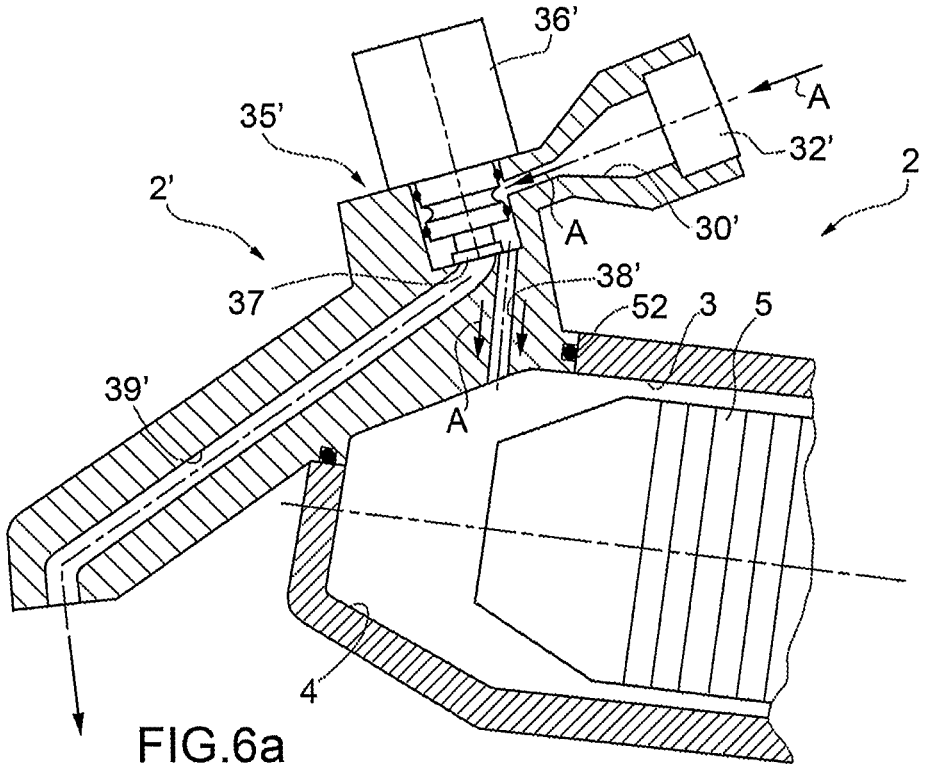
FIG. 6*a* is a cross-section, drawn to an enlarged scale, of another variant of the valve group and discharge group of the positive-displacement pump of the present invention in an intake condition of the positive-displacement pump.
Figure 6B:
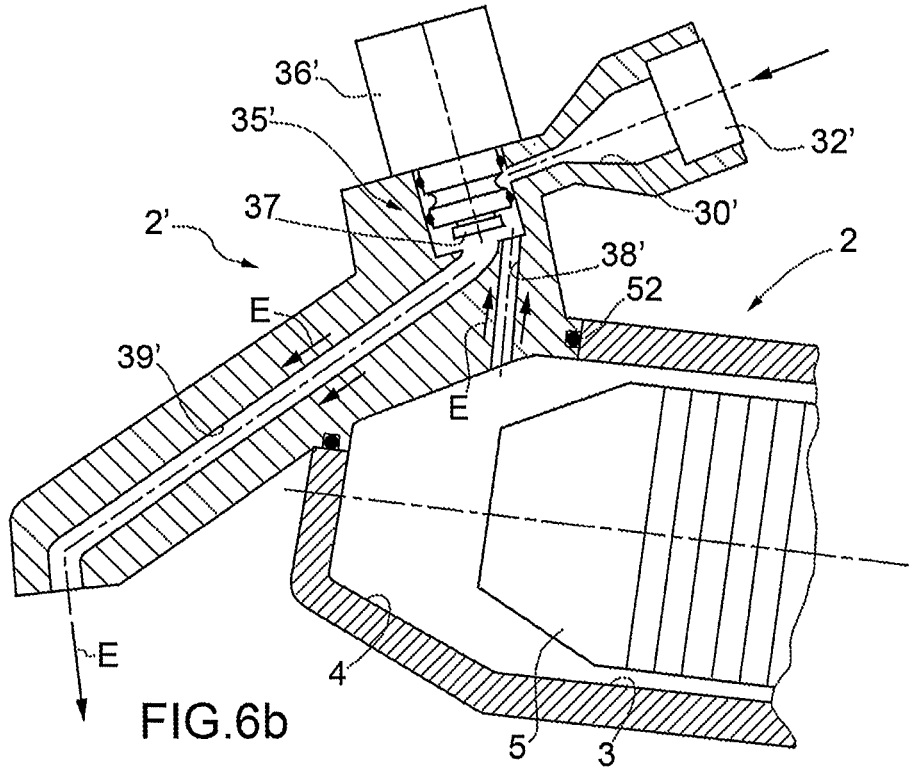
FIG. 6*b* is a cross-section similar to FIG. 6*a*, in a discharge condition of the positive-displacement pump.

Advantageously, the head group 2" can be interchanged with a head group which is similar to the one in FIG. 4 and which is also shown in FIGS. 6*a* and 6*b* in a slightly different configuration. FIG. 6*a* in particular shows the positive-displacement pump having the valve 35' in an intake condition. In this case, the closure member 37 closes the opening of the discharge pipe 39' and a backward movement of the piston 5 allows the fluid product contained in the tank which is connected to the intake opening 32' to flow through the intake pipe 30' in accordance with the direction of the arrows A in order to fill the pumping chamber 3. However, FIG. 6*b* shows the same positive-displacement pump having the valve 35' in a discharge condition. In this case, the closure member 37 closes the opening of the intake pipe 30' and an advance movement of the piston 5 allows the fluid product contained in the pumping chamber 3 to be discharged from the pumping pipe 38' and then to pass through into the discharge pipe 39' in accordance with the direction of the arrows E in order to arrive at the discharge nozzle (not shown in the Figure) which is positioned at the end of the discharge pipe 39'.

The cylindrical capacity of the positive-displacement pump 1 is given by the maximum useful volume of the pumping chamber 3 when the piston 5 is in the zero position, which is found, for example, by the sensor 25, and corresponds to the position in which the three-way valve 35 or 35' can be switched from the recirculation condition to the discharge condition after the mechanical play has been taken up and the air in the fluid product contained in the pumping chamber 3 has been eliminated or compressed.

The maximum quantity of fluid product which can be discharged in a single advance travel of the piston 5 is proportional to the cylindrical capacity of the positive-displacement pump 1.

The resolution of the positive-displacement pump, that is to say, the minimum quantity of fluid product which can be discharged per single step of the stepping motor 22, is instead inversely proportional to the cylindrical capacity of the positive-displacement pump. The optimum cylindrical capacity of a positive-displacement pump depends on the intrinsic characteristics of the fluid product to be discharged, for example, the viscosity thereof, and on subjective characteristics in terms of consumption of the fluid product. For example, in the field of colorant dispensing machines, the dispensing of yellow colorant is normally far greater than the dispensing of the colour viola. For those reasons, it is advantageous to be able to provide a positive-displacement pump which, with little effort and cost, can be produced with a cylindrical capacity which is different in accordance with the use for which it is intended.

Figure 7A:
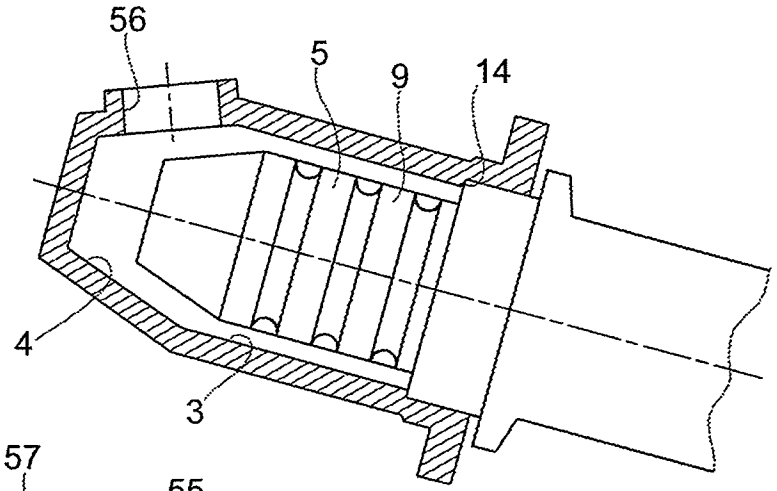
FIGS. 7*a* and 7*b* are cross-sections of a variant of the pumping chamber of the positive-displacement pump according to the present invention which is without and with a reduction adapter of the cylindrical capacity, respectively.
Figure 7B:
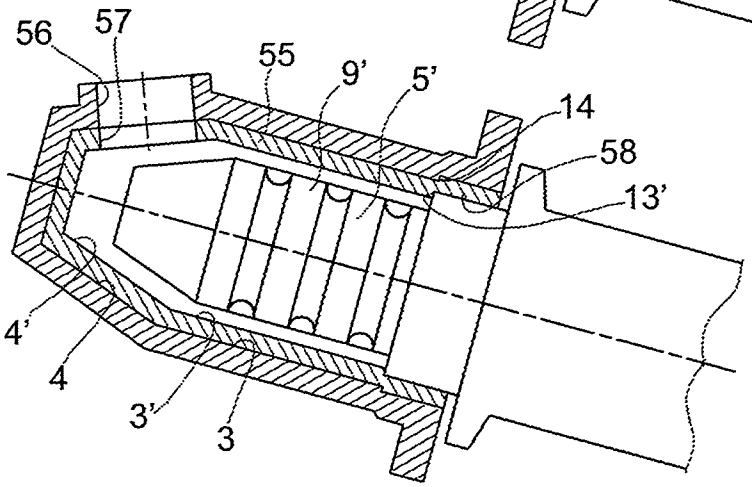

FIGS. 7*a* and 7*b* are partial sections of a pumping chamber 3' of the positive-displacement pump according to the present invention which is without and with an adapter 55 for reducing the cylindrical capacity, respectively. In greater detail, FIG. 7*a* is a cross-section of a pumping chamber 3 which is similar to the one described above, with a pumping opening 56. As set out previously, the pumping chamber 3 has a constricted end 4, which is preferably substantially frustoconical and at the inner side of which a piston 5 slides with an external sleeve 9 of the bellows type.

When it is desirable to provide a positive-displacement pump with a smaller cylindrical capacity, for example, in order to change from a cylindrical capacity of 5 cc to a cylindrical capacity of 1.7 cc, it is possible to reduce the volume of the pumping chamber 3 by means of the adapter 55 which has a substantially cylindrical form with a constricted end 4' and which is preferably substantially frustoconical and which is suitable for covering the internal walls of the pumping chamber 3 so as to produce a reduced pumping chamber 3'. The adapter has an opening 57 which is placed in correspondence and preferably substantially aligned with the pumping opening 56 of the pumping chamber 3. The adapter 55 has at the bottom an annular step 58 which, at the outer side thereof, moves into abutment with the abutment member 14 while, at the inner side thereof, it acts as an abutment for the annular portion 13' having a greater diameter of a sleeve 9' of a piston 5' which has a total diameter which is smaller with respect to the piston 5 in order to adapt to the smaller volume of the pumping chamber 3'.

If the quantity of fluid product to be discharged is greater than the cylindrical capacity of the positive-displacement pump, the discharge operation which can be actuated with a single positive-displacement pump is necessarily discontinuous, because at the end of the advance travel of the piston 5 it is necessary to switch the three-way valve into the intake condition and to move back the piston 5 until the pumping chamber 3 moves back to fill with fluid product from the tank which is connected to the intake pipe 30, 30'. In some cases, there is a need to improve and make faster the discharge of the complete quantity of the fluid product, avoiding down times as a result of the filling of the pumping chamber 3. In those cases, it is advantageous to mount a pair of positive-displacement pumps which act in a non-parallel manner in such a manner that each of them takes fluid product from the same tank (or from an individual tank containing the same fluid product which is also charged in the tank of the other pump) when the other positive-displacement pump is in the discharge condition.

This continuous discharge behaviour for a fluid product can be brought about by means of the synchronized control of the pair of positive-displacement pumps by means of the electronic logic control unit, which provides for the synchronization of the movement of the respective stepping motors 22 and the three-way valves 35, 35' of the two positive-displacement pumps, or also as a result of a configuration of a mechanical connection which will be described below with reference to FIG. 8.

Figure 8:
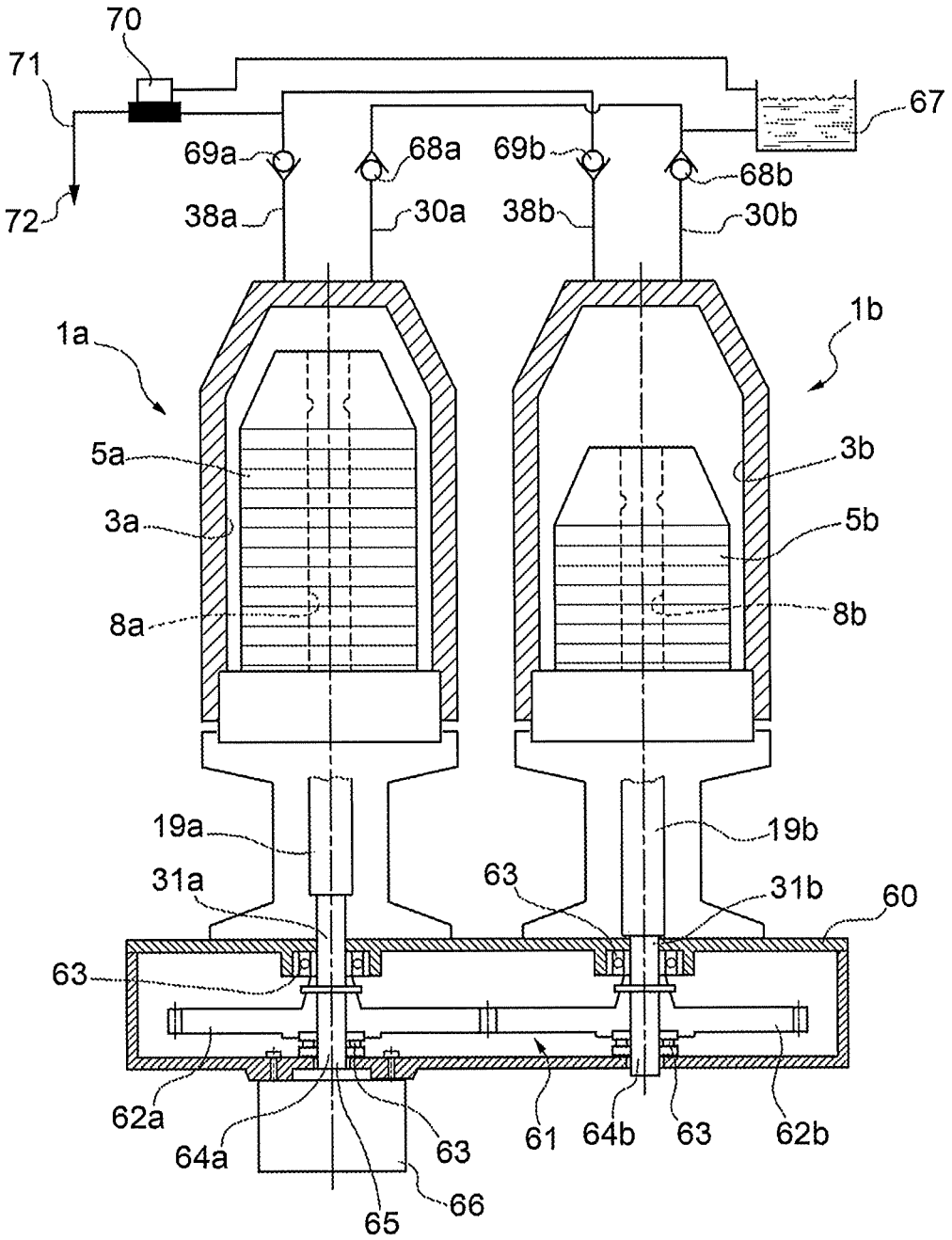
FIG. 8 is a schematic view of a pumping group comprising two positive-displacement pumps according to the invention which are connected in a non-parallel manner.

FIG. 8 is a schematic illustration of a pair of positive-displacement pumps of the present invention which are connected in a non-parallel manner for discharging fluid product in a substantially continuous manner in quantities greater than the cylindrical capacity of each positive-displacement pump taken individually.

In greater detail, two positive-displacement pumps 1*a*, 1*b* each comprise a pumping chamber 3*a*, 3*b* which is similar to the pumping chamber 3 of the pump described above, in which there are mounted in a sliding manner respective pistons 5*a*, 5*b* which are capable of moving in a non-parallel manner: when the piston 5*a* advances in the pumping chamber 3*a*, the piston 3*b* moves back in the pumping chamber 3*b* thereof, and vice versa. Each piston 5*a*, 5*b* has a respective central shaft 8*a*, 8*b* which extends into a respective handling shank 19*a*, 19*b* which is connected to a respective handling screw 31*a*, 31*b* which is mounted on a transmission casing 60 in which there is received a gear mechanism 61 comprising two toothed wheels 62*a*, 62*b* having a gearing ratio of 1. Each toothed wheel 62*a*, 62*b* is supported in the transmission casing 60 by bearings 63 and is fitted to a handle 64*a*, 64*b* of a respective handling screw 31*a*, 31*b*. The handle 64*a* of one of the two handling screws 31*a* extends and is fixed to the drive shaft 65 of a single stepping motor 66 which is fixed to the transmission casing 60. The mutual angular position of the toothed wheels 62*a*, 62*b* is such that, when the handling shank 19*a* of one of the two pumps 1*a* is at the maximum extent thereof, the handling shank 19*b* of the other pump 1*b* is in the position of maximum withdrawal thereof. The actuation of the stepping motor 66 brings about the non-parallel movement of the two handling shanks 19*a*, 19*b* and therefore of the pistons 5*a*, 5*b* of the two pumps 1*a*, 1*b*.

FIG. 8 also illustrates an alternative configuration of the intake and discharge pipes of the pumps 1*a*, 1*b*, each comprising non-return valves in place of the three-way valves. In greater detail, the intake pipes 30*a*, 30*b* of the two positive-displacement pumps 1*a*, 1*b* each have a non-return valve 68*a*, 68*b* which allows the fluid product from a tank 67 to be introduced into the respective pumping chambers 3*a*, 3*b* during the withdrawal movement of the corresponding piston 5*a*, 5*b*, and prevents the return of fluid product to the tank 67 through the same intake pipe 30*a*, 30*b*. Similarly, there are mounted on the respective discharge pipes 39*a*, 39*b* non-return valves 69*a*, 69*b* which allow the discharge of fluid product towards a common three-way valve 70, which communicates at one side with the tank 67 and at the other side with a common discharge pipe 71, which terminates with a common nozzle 72. The switching of the common three-way valve 70 allows the fluid product discharged by each positive-displacement pump 1*a*, 1*b* during the advance travel of the respective piston 5*a*, 5*b* to be conveyed alternately towards the tank 67, in a recirculation condition, or towards the common discharge pipe 71 and the nozzle 72 for the discharge of fluid product.

Naturally, the principle of the invention remaining the same, the forms of embodiment and construction details may be varied widely with respect to those described and illustrated, without thereby departing from the scope of the present invention.

The invention claimed is:

1. A positive-displacement pump for fluid products, said pump comprising:

a pump body forming an elongated pumping chamber, the pumping chamber having a longitudinal axis, the longitudinal axis of the pumping chamber being inclined in a non-vertical manner with respect to a horizontal plane, the pumping chamber having a summit zone which includes a highest location of the pumping chamber and an opening disposed immediately adjacent and in fluid communication with the summit zone, the opening having a cross-sectional dimension;

an intake pipe disposed to receive a fluid product from a tank containing the fluid product, the intake pipe being in fluid communication with the opening of the pumping chamber to provide the fluid product from the tank thereto, the intake pipe defining a fluid travel path for the fluid product with a constant descent from the tank; and a piston slidably mounted in the pumping chamber, the piston being controlled for reciprocating movement within said pumping chamber and relative to said pump body to vary a fluid product-receiving volume of the pumping chamber, wherein movement of the piston within the pumping chamber in a first direction increases the fluid product-receiving volume of the pumping chamber and conveys fluid product from the intake pipe into the pumping chamber, and movement of the piston within the pumping chamber in a second direction decreases the fluid product-receiving volume of the pumping chamber and discharges fluid product therefrom, the piston having a maximum withdrawal position within the pumping chamber as a result of movement of the piston in the first direction, the pumping chamber having a length extending along the longitudinal axis thereof, the length of the pumping chamber being defined between a terminal head end of the piston when in the maximum withdrawal position and an end wall of the pump body defining part of the pumping chamber and disposed in opposed and facing relation with the terminal head end of the piston, the cross-sectional dimension of the opening being substantially less than the length of the pumping chamber.

2. The positive-displacement pump according to claim 1, wherein the pumping chamber is substantially cylindrical and has a constricted end disposed adjacent the end wall, the summit zone being positioned near or in the region of the constricted end.

3. The positive-displacement pump according to claim 2, wherein the end wall forms part of the constricted end and the constricted end is substantially frustoconical, the summit zone being positioned substantially near or in the region of a transition between the substantially cylindrical portion and the constricted end.

4. The positive-displacement pump according to claim 2, wherein the terminal head end of the piston is constricted to complement the constricted end of the pumping chamber.

5. The positive-displacement pump according to claim 1, further including a discharge pipe disposed to discharge the fluid product, a head body mounted on the pump body, the pumping chamber being in fluid communication with the discharge pipe, the intake pipe and the discharge pipe being formed integrally with the head body.

6. The positive-displacement pump according to claim 1, further including a discharge pipe disposed to discharge the fluid product, and a three-way valve, wherein the pumping chamber is in fluid communication with the three-way valve which is actuated for selective fluid communication with the intake pipe and the discharge pipe.

7. The positive-displacement pump according to claim 6, wherein the three-way valve comprises a valve chamber arranged above the pumping chamber, the intake pipe being inclined upwards, with respect to a horizontal plane, from the valve chamber.

8. The positive-displacement pump according to claim 6, comprising a head body mounted on the pump body, the three-way valve being mounted on the head body.

9. The positive-displacement pump according to claim 8, wherein the three-way valve comprises an actuator member mounted on the head body.

10. The positive-displacement pump according to claim 1, wherein the piston includes an outer skirt in the form of a bellows.

11. The positive-displacement pump according to claim 1, further including a discharge pipe disposed to discharge the fluid product, and a single pumping pipe extending from the pumping chamber and in fluid communication with the intake pipe and the discharge pipe, the pumping pipe leading into the pumping chamber at the summit zone thereof.

12. The positive-displacement pump according to claim 1, comprising a head body mounted on the pump body, and a first interception member provided on the intake pipe, the first interception member being mounted on the head body.

13. The positive-displacement pump according to claim 12, comprising a discharge pipe disposed to discharge the fluid product, and a second interception member provided on the discharge pipe, the second interception member being mounted on the head body.

14. The positive-displacement pump according to claim 1, further including a motor mounted on a support fixed to the pump body, the piston being operationally connected to the motor.

15. The positive-displacement pump according to claim 1, further including a liner disposed inside the pumping chamber.

16. The positive-displacement pump according to claim 15, wherein the pumping chamber comprises a substantially cylindrical portion with a constricted end and the end wall forms part of the constricted end, the liner comprising a cylindrical portion and a constricted end, a geometry and external dimensions of the liner corresponding substantially to a geometry and internal dimensions of the pumping chamber so that the liner covers internal walls of the pumping chamber.

17. The positive-displacement pump according to claim 15, further including an abutment member disposed at an end of the pumping chamber axially spaced from the end wall, the piston having an external covering of bellows-like form and an annular portion, the liner having an annular step with an outer side disposed to abut the abutment member and an inner side acting as an abutment for the annular portion of the piston, the annular portion having a greater diameter than the external covering.

18. The positive-displacement pump according to claim 15, wherein the liner comprises an opening disposed in alignment with the opening of the pumping chamber, the opening of the pumping chamber and the opening of the liner being positioned in the summit zone of the pumping chamber.

19. A pumping group comprising at least two positive-displacement pumps according to claim 1, the at least two positive displacement pumps being operationally connected such that movement of the piston of one of the at least two positive-displacement pumps in the first direction corresponds to movement of the piston of the other of the at least two positive-displacement pumps in the second direction.

20. The pumping group according to claim 19, wherein the at least two positive-displacement pumps are connected by a gear mechanism controlled by a single motor.

21. A method for using a positive-displacement pump according to claim 1, the intake pipe being connected to the tank of fluid product and the pump further including a discharge pipe disposed to discharge the fluid product, the pump comprising an interception arrangement which can be selectively controlled in order to open and close the intake pipe and the discharge pipe, the method comprising the steps of:

controlling the interception arrangement in order to open the intake pipe and to close the discharge pipe;

controlling the piston so as to move in the first direction in order to transfer a quantity of fluid product from the tank to the pumping chamber;

controlling the piston so as to move in the second direction and keeping the intake pipe open and the discharge pipe closed; and opening the discharge pipe and closing the intake pipe during the movement of the piston in the second direction in order to discharge a quantity of fluid product.

22. The method according to claim 21, wherein the step of controlling the piston to move in the second direction and keeping the intake pipe open and the discharge pipe closed includes keeping the intake pipe open and the discharge pipe closed for a first part of the movement of the piston in the second direction to urge the fluid product contained in the pumping chamber towards the intake pipe, and the step of opening the discharge pipe and closing the intake pipe during the movement of the piston in the second direction is carried out during a second part of the movement of the piston in the second direction, the second part being subsequent to the first part.

23. The positive-displacement pump according to claim 1, wherein the intake pipe is disposed above the pumping chamber and receives the fluid product from the tank located above the pumping chamber, the intake pipe being oriented so as to direct the fluid product into the pumping chamber from a location above the summit zone.

24. The positive-displacement pump according to claim 23, further including a discharge pipe disposed to discharge the fluid product from the pumping chamber, part of the intake pipe being disposed vertically above the discharge pipe.

25. The positive-displacement pump according to claim 1, wherein the pumping chamber and the longitudinal axis thereof are oriented so as to be inclined in an ascending manner relative to the horizontal plane in a direction towards the summit zone of the pumping chamber.

26. The positive-displacement pump according to claim 1, further including a discharge pipe disposed to discharge the fluid product from the pumping chamber, and the pumping chamber is in fluid communication with both the discharge pipe and the intake pipe through the opening.

27. The positive-displacement pump according to claim 1, further including a valve disposed between the intake pipe and the pumping chamber, the valve having an intake position in which the valve permits flow of fluid product between the intake pipe and the pumping chamber through the opening.

28. The positive-displacement pump according to claim 1, wherein the intake pipe, with respect to a fluid-flow direction through the positive-displacement pump, has an upstream end disposed to receive the fluid product from the tank and a downstream end disposed to deliver the fluid product to the opening of the pumping chamber.

29. A positive-displacement pump for fluid products, said pump comprising:

a pump body defining a pumping chamber configured for receiving a fluid product therein, the pumping chamber being elongated so as to extend along a longitudinal axis, the longitudinal axis being inclined relative to a horizontal plane, the pumping chamber having an opening disposed immediately adjacent and in fluid communication with a summit zone located within and defining part of the pumping chamber, the summit zone including a highest vertical location of the pumping chamber;

a piston slidably disposed within the pumping chamber and controlled for movement within the pumping chamber to vary a volume thereof;

an intake pipe disposed to receive a fluid product from a tank and defining a path of travel for the fluid product, the path of travel being oriented such that the fluid product descends as the fluid product travels in a direction away from the tank and through the intake pipe, the intake pipe being fluidly connected to the pumping chamber through the opening thereof immediately adjacent the summit zone such that the pumping chamber receives fluid product from the intake pipe; and a valve disposed between the intake pipe and the opening of the pumping chamber, the valve having an intake position in which the valve permits flow of fluid product between the intake pipe and the pumping chamber.

30. The positive-displacement pump according to claim 29, wherein the pumping chamber and the longitudinal axis thereof are oriented so as to be inclined in an ascending manner relative to the horizontal plane in a direction towards the summit zone of the pumping chamber.

31. The positive-displacement pump according to claim 30, wherein the intake pipe is disposed above the pumping chamber and receives the fluid product from the tank located above the pumping chamber, the intake pipe being oriented so as to direct the fluid product into the pumping chamber from a location above the summit zone, the pump further including a discharge pipe disposed in fluid communication with the intake pipe, and at least part of the intake pipe is disposed vertically above the discharge pipe.

32. The positive-displacement pump according to claim 29, further including a discharge pipe disposed to discharge fluid from the pumping chamber, and the pumping chamber is in fluid communication with both the discharge pipe and the intake pipe through the opening.

33. A positive-displacement pump for fluid products, said pump comprising:

a pump body forming a pumping chamber, the pumping chamber having a longitudinal axis, the longitudinal axis of the pumping chamber being inclined in a non-vertical manner with respect to a horizontal plane, the pumping chamber having a summit zone which includes the highest location of the pumping chamber and an opening disposed immediately adjacent and in fluid communication with the summit zone;

an intake pipe disposed to receive a fluid product from a tank containing the fluid product, the intake pipe being in fluid communication with the opening of the pumping chamber to provide the fluid product from the tank thereto, the intake pipe defining a fluid travel path for the fluid product which descends from the tank;

a piston slidably mounted in the pumping chamber, the piston being controlled for reciprocating movement within said pumping chamber and relative to said pump body to vary a fluid product-receiving volume of the pumping chamber, wherein movement of the piston within the pumping chamber in a first direction increases the fluid product-receiving volume of the pumping chamber and conveys fluid product from the intake pipe into the pumping chamber, and movement of the piston within the pumping chamber in a second direction decreases the fluid product-receiving volume of the pumping chamber and discharges fluid product therefrom; and a discharge pipe disposed to discharge the fluid product from the pumping chamber, the pumping chamber being in fluid communication with the discharge pipe and the intake pipe through the opening.

34. The positive-displacement pump according to claim 33, further including a valve disposed between the intake pipe and the pumping chamber, the valve having an intake position in which the valve permits flow of fluid product between the intake pipe and the pumping chamber through the opening.

* * * * *